United States Patent [19]

Andersen

[11] Patent Number: 4,731,275

[45] Date of Patent: Mar. 15, 1988

[54] CARPET ASSEMBLY WHICH RESISTS LATERAL MOVEMENT AND PROCESS OF PRODUCING THE SAME

[75] Inventor: Walter R. Andersen, Dalton, Ga.

[73] Assignee: 501 Andersen Company, Inc., Dalton, Ga.

[21] Appl. No.: 946,894

[22] Filed: Dec. 29, 1986

[51] Int. Cl.[4] ..... A01N 3/00

[52] U.S. Cl. ..... 428/95; 156/70; 156/209; 156/220; 156/289; 156/324; 156/449; 156/582

[58] Field of Search ..... 428/95; 156/70, 209, 156/220, 289, 324, 449, 582

[56] References Cited

U.S. PATENT DOCUMENTS 4,278,482 7/1981 Poteet ..... 428/95

4,387,130 6/1983 See ..... 428/95

*Primary Examiner*—Marion C. McCamish

*Attorney, Agent, or Firm*—Hurt, Richardson, Garner, Todd & Cadenhead

[57] ABSTRACT

A carpet tile assembly which resists lateral movement and a process of producing the same are disclosed, the carpet tiles having a tufted carpet layer or similar surface and a second layer of elastomeric material vulcanized to the carpet layer. The second layer has a plurality of protrusions formed therein and a plurality of spikes on the protrusions which together engage a base layer which may be either a mirror image of the second layer or a needle-punched or felt-like fiber mat to resist lateral movement of the applied tiles. The process involves tufting carpet yarn into a substrate and then vulcanizing the second, elastomeric or resilient layer to the substrate. In the vulcanization process, heat and pressure are applied to soften the elastomeric material and force the material through cavities in a perforated sheet to form the protrusions.

15 Claims, 5 Drawing Figures

CARPET ASSEMBLY WHICH RESISTS LATERAL MOVEMENT AND PROCESS OF PRODUCING THE SAME

BACKGROUND OF THE INVENTION

Carpeting may be provided in rectangular pieces or tiles which are laid down side-by-side and fastened to the decking or floor, usually with adhesives. This facilitates carpet installation and allows the installer to create patterns for example, or to easily carpet around permanent obstacles such as pillars, with a minimum of cutting and/or tedious measurements. Such installations also eliminate the need for stretching and seaming the carpet, tasks which are difficult but required for conventional carpeting installations.

While such tiles or squares are easily installed, removal is a difficult proposition, due to the adhesive securing employed. This can be especially difficult when the carpet tiles have a foam backing since remnants of the foam normally remain adhered to the decking and must be scraped off or otherwise removed before a new carpet or other covering is installed.

SUMMARY OF THE INVENTION

It is, therefore, one of the principal objects of the present invention to provide a carpet tile assembly which is easily installed and which is also easily removed whenever desired to facilitate, for example, relocation of computer/phone etc. cables in a modular office environment.

Another object of the present invention is to provide a carpet tile assembly that can be used for indoor or outdoor installations, with or without adhesives, and which is durable for providing a long service life.

A further object is to provide a process for producing the present carpet tile which easily lends itself to mass production, and which consistently produces a carpet tile assembly of uniform quality.

These and additional objects are attained by the present invention which relates to a carpet tile assembly and method for producing the same having a base member and a covering member which serves as the carpet surface, the members having facing surfaces which interact to hold the covering members or tiles in place. The assembly can be installed on new decking or over vinyl sheet material or any hard surface if desired, since the assembly forms a complete carpet installation. The assembly requires no adhesives and is easily trimmed to fit corners, edges, or around fixed obstacles.

The process involves tufting a conventional carpet and then adding a secondary backing which is formed into a holding surface by the instant process. The base member is produced in a similar fashion.

Various additional objects and advantages of the present invention will become apparent from the following description, with reference to the accompanying drawings.

DETAILED DESCRIPTION OF THE PREFERRED EMBODIMENT

Referring now more specifically to the drawings, and to FIG. 1 in particular, numeral 10 designates generally the carpet tile assembly comprising part of the present invention, the method of producing the tiles being detailed hereinbelow. The tile assembly is shown here as the installation thereof is proceeding. While shown as squares, the tiles may have other rectangular shapes, and may be easily trimmed for fitting the specific dimensions of the installation site. An example would be entrance mats in office buildings and the like which are set into recesses in the floor.

The carpet tiles 12 can be produced using a conventional tufting machine with the yarn 14 inserted by needles into a conventional backing or substrate 16, such as woven polypropylene. The yarn may be a cut pile, as shown, a looped pile, or the tile surface can be a synthetic material. Another possible tile surface may be produced with needle punched or non-woven fabrics.

Figure 4:
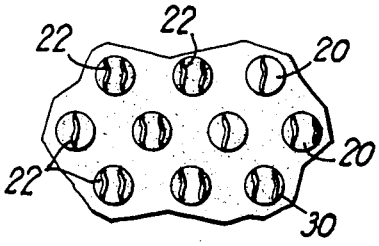
FIG. 4 is a partial bottom plan view of the lower surface of the carpet tile, the view being taken on line 4—4 of FIG. 2.

The next step in the process may be carried out either before or after the roll of carpet produced by the tufting machine is cut into rectangular tiles. The step involves applying a secondary backing 18 over the woven polypropylene and vulcanizing the secondary backing to the primary polypropylene backing. The secondary backing is normally a resilient or elastomeric matieral and may be formed of certain suitable elastomers, such as styrene-butadiene rubber, of certain suitable thermoplastics, such as PVC, of certain suitable thermoplastic elastomers, or even certain urethanes, and including other materials from these groups having similar properties. The secondary backing is in an uncured state upon its application to the primary backing. Heat and pressure are applied to this secondary backing in order to vulcanize it to the primary backing, the secondary and primary backings becoming integrally joined. The heat and pressure are applied with conventional equipment through a platen or a similar press-type mold as the materials are passed around or under the surface thereof. A perforated metal sheet is placed over the uncured secondary backing or the secondary backing is placed over the perforated sheet, the sheet having a plurality of indentations or cavities through which the secondary backing material is extruded as heat and pressure are applied, thereby forming radially extending protrusions or cleats 20 which conform to the indentations in the perforated sheet as the heated material is forced therethrough. Thus, the sheet used to form the protrusions shown here has generally cylindrical perforations and produces the cylindrical protrusions seen in FIG. 4. As a consequence interstices 21 are also formed between the cleats 20.

In the process, by way of example, the material to be joined is sandwiched between the heated platen and a perforated metal sheet on a release belt. The belt conveys the material to the press, the press operates and releases after curing of the backing, and the finished tile is peeled off while still warm, a suitable release agent being employed as necessary.

As the process continues, the heat and pressure applied through the press cures the secondary backing and bonds the secondary backing to the primary backing. During the process, one or more spike means 22 are formed on the outer end surface of the protrusions 20. The spike means extend radially from the upper surface of the protrusions and are formed in the molding process, the heated material being pressed into any and all cavities in the metal sheet or the like which is used to form the protrusions or cleats. The process also causes the cleats to have slightly flared outer edge portions 30, which aid in gripping the base member and in the interlocking of the secondary backing with mat 26, the slight flare formed as a result of the pressure applied to the heated secondary bacing. The finished carpet is then cut into rectangular members such as squares, if this has not already been done before vulcanization of the secondary backing.

Figure 2:
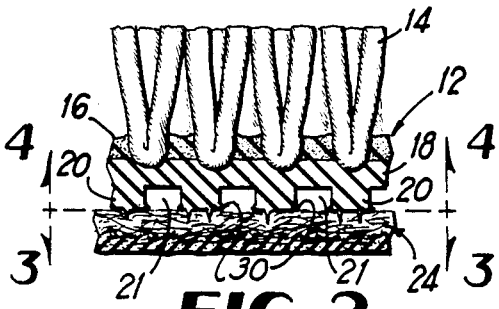
FIG. 2 is a cross sectional view of one embodiment of the assembly, the section being taken on line 2—2 of FIG. 1.
Figure 3:
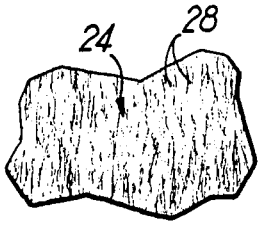
FIG. 3 is a partial top plan view of one embodiment of the base member, the view being taken on line 3—3 of FIG. 2.
Figure 5:
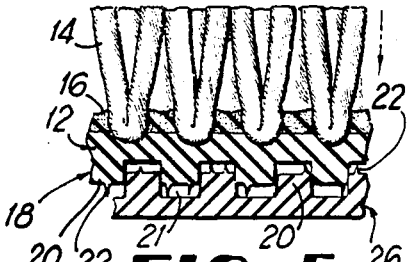
FIG. 5 is a partial, side elevational view of the present carpet tile assembly, the view being in cross section and showing an alternate embodiment of the base member.

The carpet tiles are installed over a base member such as a needle-punched or a felt-like mat 24 (FIG. 3). The mat is formed from a plurality of individual fibers 28 which have been pressed flat and bonded together with latex or a similar material. The mat may also be formed as essentially a mirror image of the secondary backing 18, as shown in FIG. 5, the alternate base member or mat 26 having protrusions 20 extending radially upwardly therefrom. The protrusions are formed using the same mandrel or press used to produce backing 18, the process also forming the radially extending spike means 22 on the outer ends of the protrusions, as is shown for the carpet tiles in FIGS. 2 and 5. The upper surface of the mats formed from individual fibers or the cleats and spikes of mat 26 thus form a means to engage the cleats and spike means of the lower surface of the carpet tiles.

Figure 1:
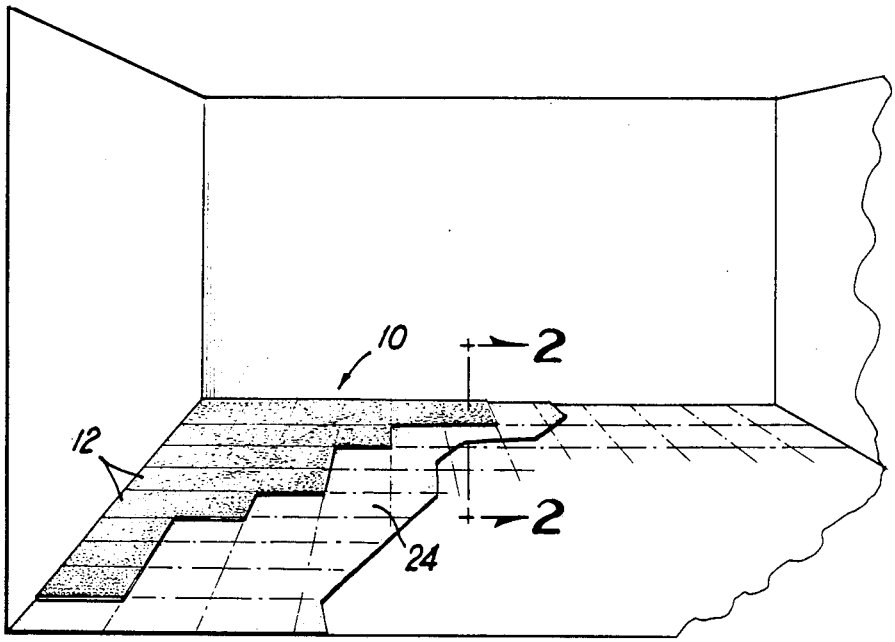
FIG. 1 is a partial, perspective view of a room showing the present carpet tile assembly in an installed position, the installation being partially completed.

In either case, the base member, preferably in a continuous sheet or roll, is laid over the floor to be covered, as shown in FIG. 1, and fastened thereto, as with adhesives, staples, tack strips, etc. (not shown), the fastening being permanent or semi-permanent as desired. The individual carpet tiles are then laid down over the base member and pressed down to engage the facing surfaces. Seaming of the base member, as in a large room, is not necessary as a row of tiles may be applied over the seam, and as the facing surfaces are interengaged, the seam is held together.

In the installation using the felt-like mat 24, the spike means 22 and the slightly flared outer edge portions 30 of the protrusions formed on the lower surface of the carpet tiles engage the individual fibers 28 to resist lateral movement of the tiles. In the installation using the mat 26, the protrusions and the spike means of the facing surfaces become interlocked as pressure is applied to the carpet tiles, this being indicated by the cross-section of FIG. 5. This interlocking thus resists lateral movement of the tiles. Vertical movement of the tiles is only minimally affected and the tiles may be easily lifted from the mat for replacement if necessary or simply to change the pattern of the carpet.

Upon completion of the installation, pressure on the tiles, as from walking thereon or the placement of furniture thereon, tends to increase the bonding due to the interlocking of the facing surfaces, the cleats of one surfae entering the interstices 21 between the cleats of the facing surface, as shown in FIG. 5, or with the needle-punched fibers, as shown in FIG. 2. Thus a very secure and versatile assembly is provided and may be applied in most instances where conventional carpeting is normally used.

While an embodiment of a carpet tile assembly which resists lateral movement and a process for producing the same and modifications thereof have been shown and described in detail herein, various other changes and modifications may be made without departing from the scope of the present invention.

I claim:

1. A carpet tile assembly for application over and engagement with a base layer, said tile assembly comprising a tile member having an upper traffic-bearing layer integrally engaged with a substrate, a second layer of elastomeric material integrally bonded to said substrate, said second layer having a plurality of protrusions extending radially downwardly therefrom throughout the surface area thereof and a base layer having an upper surface including means for engaging said protrusions for resisting lateral movement of said tiles applied thereon.

2. A carpet tile assembly as defined in claim 1 in which said protrusions have interstices therebetween and also include a plurality of spike means extending radially downwardly therefrom for engaging said base layer.

3. A carpet tile assembly as defined in claim 2 in which said base layer includes a plurality of individual fibers bonded together and said protrusions and spike means engage said individual fibers.

4. A carpet tile assembly as defined in claim 2 in which said base layer includes a plurality of protrusions extending radially upwardly therefrom and having interstices therebetween, for receiving and interlocking with said downwardly extending protrusions.

5. A carpet tile assembly as defined in claim 4 in which said upwardly extending protrusions each have at least one spike means extending radially upwardly therefrom for engaging said second layer.

6. A carpet tile assembly as defined in claim 5 in which said upwardly extending protrusions also include a plurality of spike means extending radially upwardly therefrom for engaging said second layer.

7. A method for producing a carpet tile assembly comprising the steps of:

(a) forming an upper surface layer bonded to a substrate for forming a first layer;

(b) applying a second layer of flowable elastomeric material over said substrate;

(c) subjecting said second layer to heat and pressure applied through a press having a perforated sheet with a plurality of cavities therein against which said second layer is pressed to vulcanize said second layer to said substrate, said elastomeric material being forced through said cavities to form radially extending protrusions corresponding to said cavities and disposed substantially throughout the surface area of said second layer;

(d) withdrawing said first and second layers from said mold;

(e) cutting said layered assembly into individual tiles; and (f) applying said tiles over a base layer, said base layer having means to engage said protrusions for resisting latral movement of said tiles.

8. A method for producing a carpet tile assembly as defined in claim 7 in which said base layer includes a plurality of individual fibers bonded together, and said protrusions engage said fibers.

9. A method of producing a carpet tile assembly as defined in claim 7 and including the further steps of forming said base layer, said further steps including (a) inserting an elastomeric material into a press;

(b) applying heat and pressure to said elastomeric material to force said material through cavities in a perforated sheet to form a plurality of protrusions with interstices therebetween; and (c) withdrawing said material from said mold, said protrusions thereby formed in said base layer for interlocking adjacent said protrusions formed in said second layer.

10. A method of producing a carpet assembly as defined in claim 9 in which said elastomeric material is a styrene-butadiene rubber.

11. A method of producing a carpet assembly as defined in claim 7 in which said first step of forming an upper surface layer includes the step of tufting yarn into said substrate.

12. A carpet tile assembly for application over a surface comprising a base layer for receiving said tile assembly and a tile member having an upper layer of carpet material for forming a walking surface, a substrate layer for receiving and holding said carpet material, a second layer of resilient material integrally joined to said substrate, and said second layer having a plurality of protrusions extending radially therefrom and disposed substantially throughout the surface area of said second layer for engaging said base layer and resisting lateral movement of said tiles.

13. A carpet tile assembly as defined in claim 12 in which said protrusions have interstices therebetween and also include a plurality of spike means extending radially downwardly therefrom for engaging said base layer.

14. A carpet tile assembly as defined in claim 13 in which said base layer includes a plurality of individual fibers bonded together and said protrusions and spike means engage said individual fibers.

15. A carpet tile assembly as defined in claim 12 in which said base layer includes a plurality of protrusions extending radially upwardly therefrom with interstices therebetween for receiving said downwardly extending protrusions and interlocking said base layer and said tile member together.

* * * * *